US005547412A

United States Patent [19]

Wilcox

[11] Patent Number: 5,547,412

[45] Date of Patent: Aug. 20, 1996

[54] CHILDREN'S STEPSTOOL WITH AUTOMATIC ELECTRONIC MESSAGE MECHANISM

[75] Inventor: James J. Wilcox, Oldwick, N.J.

[73] Assignee: Stap and a Half Toys, Oldwick, N.J.

[21] Appl. No.: 377,868

[22] Filed: Jan. 25, 1995

[51] Int. Cl.[6] ..... A63H 3/00; A63H 5/00; A63H 33/00

[52] U.S. Cl. ..... 446/73; 446/81; 446/29; 446/404; 446/482; 108/50; 182/18; 297/217.4

[58] Field of Search ..... 297/217.4, 217.3, 297/423.41; 108/50, 144; 182/15, 18; 446/71, 72, 73, 81, 29, 26, 1, 397, 404, 479, 482, 484, 485

[56] References Cited

U.S. PATENT DOCUMENTS

| | | | |
|---|---|---|---|
| D. 70,856 | 8/1926 | Park . | |
| D. 111,968 | 11/1938 | Holmes, Jr. . | |
| D. 170,471 | 9/1953 | Meagher . | |
| D. 193,241 | 7/1962 | Goldman . | |
| D. 206,711 | 1/1967 | Ralford . | |
| D. 268,148 | 3/1983 | Appel et al. . | |
| 740,071 | 9/1903 | Allen | 297/423.41 X |
| 2,809,833 | 10/1957 | Slade | 446/219 X |
| 2,826,996 | 3/1958 | Smith | 446/410 X |
| 3,696,372 | 10/1972 | Garrett et al. | 182/18 |
| 3,826,336 | 7/1974 | Cramer | 182/15 |
| 3,864,873 | 2/1975 | Watkins | 446/404 X |
| 4,624,341 | 11/1986 | Lee | 108/144 X |
| 4,934,980 | 6/1990 | Egolf et al. | 446/29 X |
| 5,074,820 | 12/1991 | Nakayama | 446/29 |

FOREIGN PATENT DOCUMENTS

| | | | |
|---|---|---|---|
| 2591501 | 6/1987 | France | 446/302 |

*Primary Examiner*—Robert A. Hafer
*Assistant Examiner*—D. Neal Mair
*Attorney, Agent, or Firm*—Kenneth P. Glynn

[57] ABSTRACT

The present invention is a stepstool for children with an automatic electronic message mechanism. The stepstool comprises a main housing including a horizontal step and a substantially vertical support having a bottom which rests on a compressive pod which in turn rests on a floor surface. Attached to the inside of the back side of the stepstool is a message mechanism whose switch is activated when weight such as that of a child is introduced to the horizontal step portion of the stepstool. The message mechanism comprises an on/off switch, power source, message chip, audio driver and a speaker which plays a predetermined message when the on/off switch is activated.

20 Claims, 4 Drawing Sheets

CHILDREN'S STEPSTOOL WITH AUTOMATIC ELECTRONIC MESSAGE MECHANISM

BACKGROUND OF THE INVENTION

1. Field of the Invention

This invention relates primarily to a children's stepstool with automatic electronic message mechanism.

2. Information Disclosure Statement

U.S. Pat. No. 70,856 issued to C. C. Park relates to a design for a bench or similar article. The design consisted primarily of a rectangular shaped board in the horizontal plane abutted and held up by two vertical supports. The purpose of the design was to convey the appearance of an animal, for example a cat, by applying a face shape to one end of the rectangular board and a tail shape to the other end. The vertical supports were shaped to convey the appearance of animal legs.

U.S. Pat. No. 111,968 issued to F. B. Holmes, Jr. relates to a design for a child's step up stool. The design consisted primarily of a rectangular shaped board in the horizontal plane secured by two end supports shaped and marked into the profiles of a rabbit.

U.S. Pat. No. 170,471 issued to A. L. Meagher relates to the design of a convertible chair and step stool unit. The design consisted primarily of a rectangular shaped seating board and a rectangular shaped back board. The seating board was held up in the near horizontal plane by two end supports shaped into squirrel bodies. The backboard was supported by two end supports shaped into squirrel tails which were rotatably connected to the two end supports shaped as squirrels. The squirrel tail end supports pivoted or rotated allowing the backboard to be in a near vertical position for a chair configuration and a near horizontal position for a step stool configuration.

U.S. Pat. No. 193,241 issued to R. Goldman and L. Goldman relates to a design for a convertible step stool. The design consisted primarily of a rectangular shaped seating board held up by two end supports shaped and or marked to appear as rabbit head profiles. These rabbit head profiles had rotatably connected large rabbit ears. The large rabbit ears supported a second rectangular shaped board. In the step stool configuration the rabbit ear supports were pivoted in the near horizontal position. In the chair configuration the large rabbit ears were rotated in the near vertical position.

U.S. Pat. No. 206,711 issued to P. R. Raiford relates to a design for a hassock which resembled the head, tail, legs and shell of a tortoise.

U.S. Pat. No. 268,148 issued to M. Appel et at. relates to the design of a combination chair and stepstool. The design consisted primarily of a horizontal rectangular shaped section which functioned as the seat in a chair configuration and a foot step in a stool configuration. The other section was a rectangular shaped section which functioned as a back support in the near vertical position when the design was in the chair configuration. The other section pivoted to a horizontal position and functioned as a first step when the design was in the stepstool configuration.

The use of a children's stepstool with an automatic electronic message mechanism has not been taught by the prior art.

SUMMARY OF THE INVENTION

The present invention is a children's stepstool with an automatic electronic message mechanism. The stepstool comprises a main housing including a horizontal step and a substantially vertical support having a bottom. In the preferred embodiment of the stepstool, the horizontal step and substantially vertical support, along with portions of legs and a front animal shaped face are mold formed into one piece from plastic. At the bottom of the substantially vertical supports are compressive pods, which have an uncompressed position when there is no weight on the stepstool and a compressed position when there is weight on the stepstool. Attached to the inside of the back of the stepstool is a message mechanism whose switch is off when the compressive pod is in an uncompressed position and whose switch is on when the compressive pod is in a compressed position. The message mechanism comprises an on/off switch, power source, predetermined message chip, audio driver and a speaker. When the on/off switch is in the "on" position from weight being put on the stepstool a message is automatically played through the speaker. The message chip is encoded with a predetermined message.

BRIEF DESCRIPTION OF THE DRAWINGS

The invention will be more fully understood when the specification herein is taken in conjunction with the drawings appended hereto, wherein.

DETAILED DESCRIPTION OF THE PRESENT INVENTION

Figure 1:
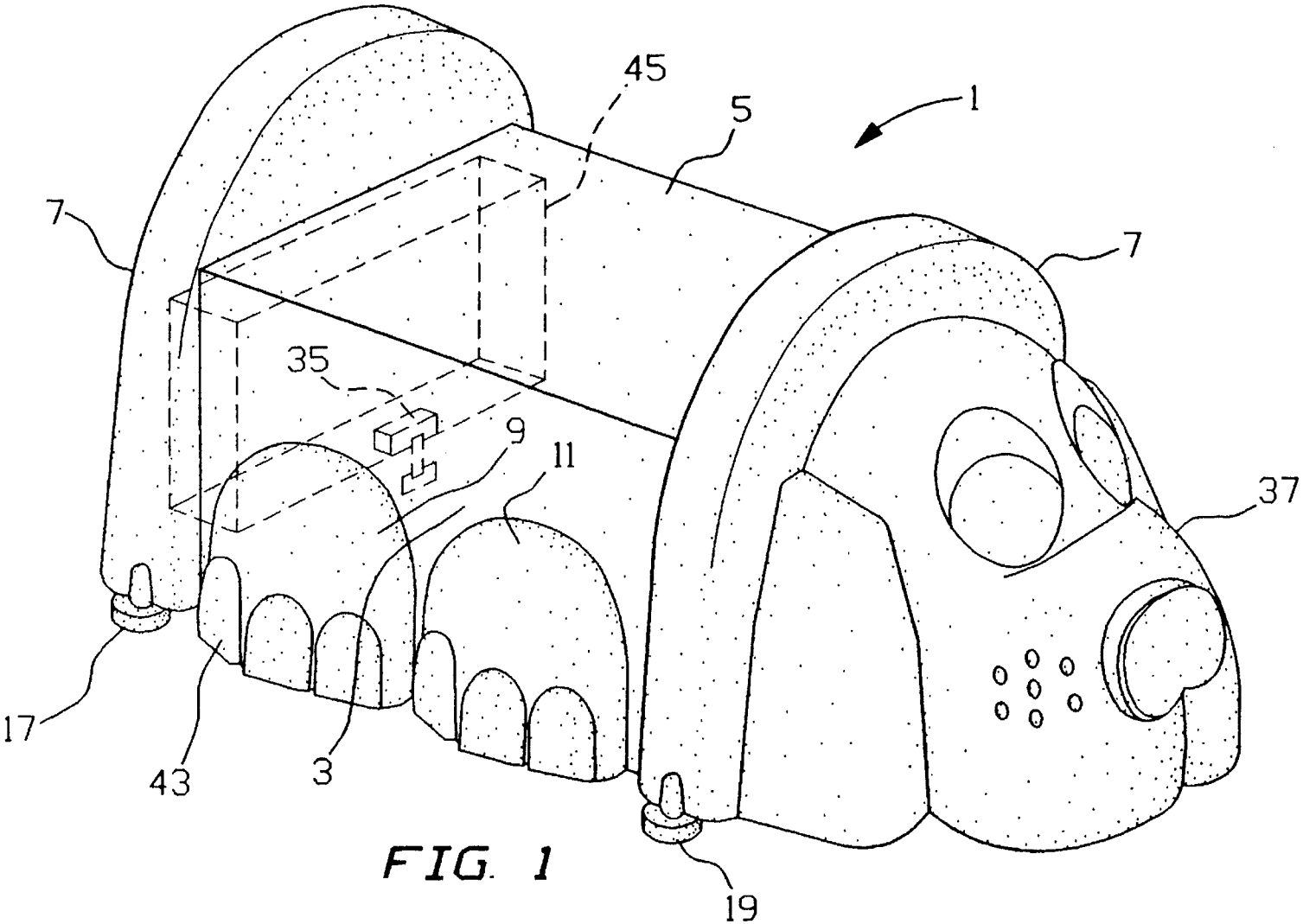
FIG. 1 is a left front perspective view of a preferred embodiment of a children's stepstool with automatic electronic message mechanism.

The present invention is a children's stepstool with automatic electronic message mechanism. The terms used herein will be explained and expounded to aid in the understanding of the present invention and its operation. The terms and uses described herein are for illustration purposes and are by no means intended to be all inclusive.

By "substantially vertical support" is meant one or more wall structures which act to support the step of the stepstool. Thus, it could be one continuous wall or a plurality of legs, and it could be a sheet material with corners, hollow, or solid. It could be perfectly vertical or tapered or tilted relative thereto for enhanced stability.

By "compressive pod" is meant one or more structural units upon which the stepstool rests and thereby contacts a floor. The compressive pod may be a single, flattenable rubber strip, a series of strips, compressible rubber rings, springs, springs encompassed by telescoping rings, etc. The compressive pods have a first, uncompressed height, and a second, shorter, compressed height which results when a predetermined weight is applied to the stepstool, e.g. 20 pounds or more.

The predetermined message chip may be encoded with a number of messages from conveying various holiday greetings, singing happy birthday to messages reinforcing hygiene tasks such as brushing teeth, washing the face and cleaning behind the ears.

The glow-in-the-dark markings may be painted on, may be paper adhesive types or integrally formed with the stepstool material. For example, glow-in-the-dark labels may be applied at the outer edges of the horizontal step and/or the uppermost portions of the side walls or vertical supports. Alternatively, the entire portion of the legs may glow in the dark. The animal shaped face may represent a dog, giraffe, elephant, donkey, bear, tortoise, or the like. The animal shaped face may be unistructurally formed from the step stool material as in the preferred embodiment or may be separately attached and interchangeable with different animal shaped faces.

The various physical elements of the stepstool such as the main housing, horizontal step, portions of legs, substantially vertical support, and animal shaped face may be unistructurally mold formed from a plastic sheet material as in the preferred embodiment. Alternatively, these various physical elements may be separately attachable and mechanically joined to form a stepstool assembly. The various physical elements could then be interchangeable with different versions of the same elements to create different looking animals. The physical elements may be formed from wood, sheet metal, glass, any other rigid sheet material and combinations or variations thereof.

The electronic message mechanism housing may be attached to the inside of the back of the stepstool by a variety of mechanical means. The housing may have extended fastener tabs as in the preferred embodiment which are secured to the inside of the stepstool by threaded fasteners. Alternatively, these tabs may snap into corresponding compression slots in the inside of the stepstool. As a further alternative, the massage mechanism housing may be chemically or solvent welded to the inside of the back of the stepstool.

The power source in a preferred embodiment of the present invention is an array of electrochemical batteries providing a direct current voltage source to energize or power the electronic components of the message mechanism. Alternatively, the power source may be a standard household alternating current voltage which is fed through an electronic industry standard transformer/rectifier apparatus to produce the necessary direct current voltage. The transformer/rectifier may be an integral component of the message mechanism or it may be external to the message mechanism and plugged into the message mechanism through a standard electrical connector.

The predetermined massage chip may be an integrated circuit digitally encoded with tones which are necessary to generate the desired composite of the predetermined message frequencies. The predetermined message chip may have an internal digital to analog converter to convert the discrete signals to analog wave forms for the audio driver to amplify or the audio driver may have an internal digital to analog converter. The audio driver may be an integrated circuit which amplifies the composite frequencies from the predetermined message chip to an amplitude sufficiently high enough to replicate the desired sounds through the speaker.

In an alternative embodiment, the audio driver may be a standard microcassette tape driver complete with an integral direct current motor drive for advancing the microcassette reel, and magnetic pickup head for retrieving the magnetized message on the microcassette tape and converting it to an amplified electrical form for transmission to a speaker. This alternative embodiment provides the ability to take out the microcassette tape and record different messages with an external microcassette tape recorder.

Figure 5:
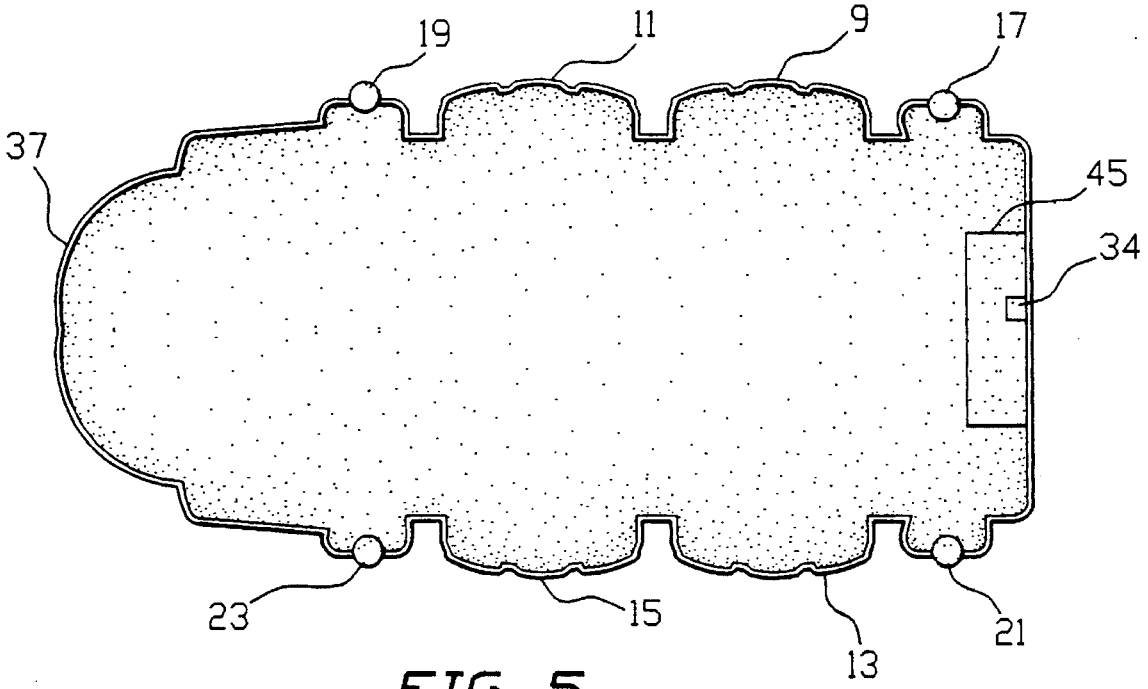
FIG. 5 is a bottom view of the preferred embodiment shown in FIG. 1.

A preferred embodiment of a children's stepstool with automatic electronic message mechanism is illustrated in FIG. 1. The top of the main housing 3 is rectangular shaped and forms the horizontal step 5 for a person such as a child to stand upon. Vertical stability is provided for by a substantially vertical support 7. The preferred embodiment shown in FIG. 1 has a substantially vertical support at each longitudinal end of the main housing 3 and horizontal step 5. At the sides of the main housing 3, as shown in FIG. 1, are portions of legs 9 and 11. There are also portions of legs 13 and 15 on the other side of the main housing 3 (see FIGS. 3 and 5). These portions of legs 9, 11, 13 and 15, in addition to having characteristic markings 43 providing the appearance of a portion of an animal's legs (dog's legs in the embodiment shown in FIG. 1) also serve as stabilizers tending to prevent the stepstool 1 from tipping or rotating in an unsafe manner about its longitudinal dimension. The portions of legs 9, 11, 13 and 15 have accent markings 43 which can have glow-in-the-dark features or provide additional characteristic markings consistent with the type of animal the stepstool 1 is supposed to embody as portrayed in the animal shaped face 37. The front portion of the stepstool 1 is an animal shaped face 37 which is a dog in FIG. 1. Alternative embodiments may have various animal shaped faces such as a cat, horse, donkey, elephant, giraffe, zebra, etc.

In the preferred embodiment of the stepstool 1, shown in FIG. 1, the various physical elements such as the main housing 3, horizontal step 5, substantially vertical support 7, the portions of legs 9, 11, 13 and 15, and the animal shaped face 37 are unistructurally formed into a thin hollow mold form from a plastic material. In an alternative embodiment, the stepstool 1 may be a unistructurally formed hollow mold with only a main housing, a horizontal step and a substantially vertical support having a bottom. In further alternative embodiments, the stepstool 1 may be an assembly of mechanically joined physical elements.

In the preferred embodiment, stepstool 1 rests on a surface such as a floor on four compressive pods 17, 19, 21 and 23 which are attached to the bottom of the substantially vertical supports 7 (see FIGS. 1, 3, 4 and 5). The attachments between the compressive pods and the substantially vertical supports are unistructurally formed from the stepstool 1. The compressive pods may be compressible rubber rings, springs, springs encompassed by telescoping rings, etc. The compressive pods have a first, uncompressed height, and a second, shorter compressed height which results when a predetermined weight is applied to the stepstool 1, e.g. twenty pounds or more.

Figure 3:
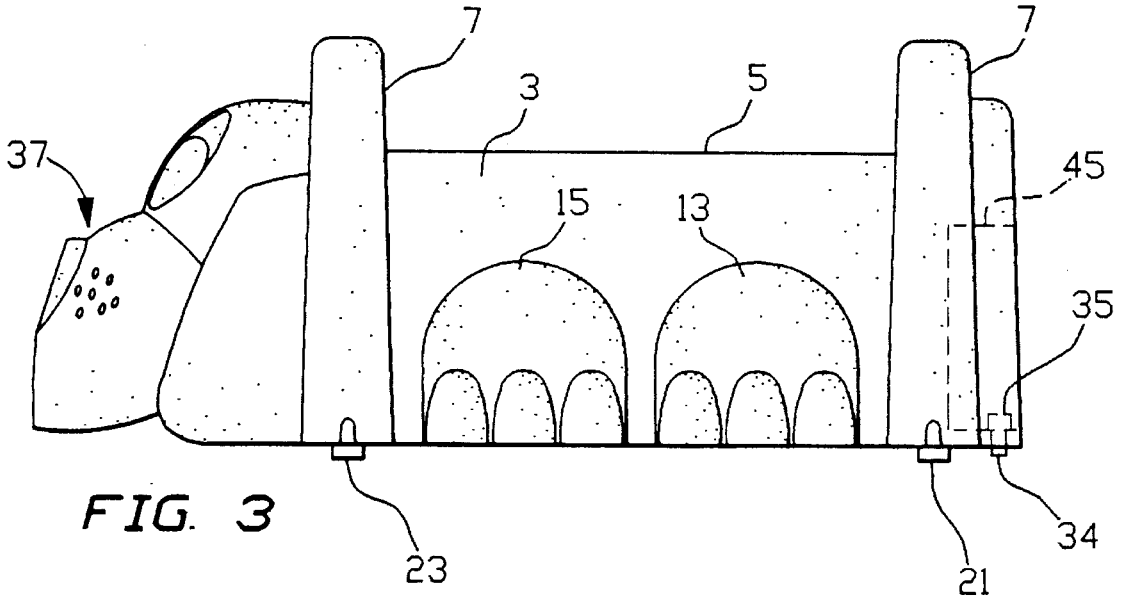
FIG. 3 is a right side view of the preferred embodiment shown in FIG. 1.
Figure 4:
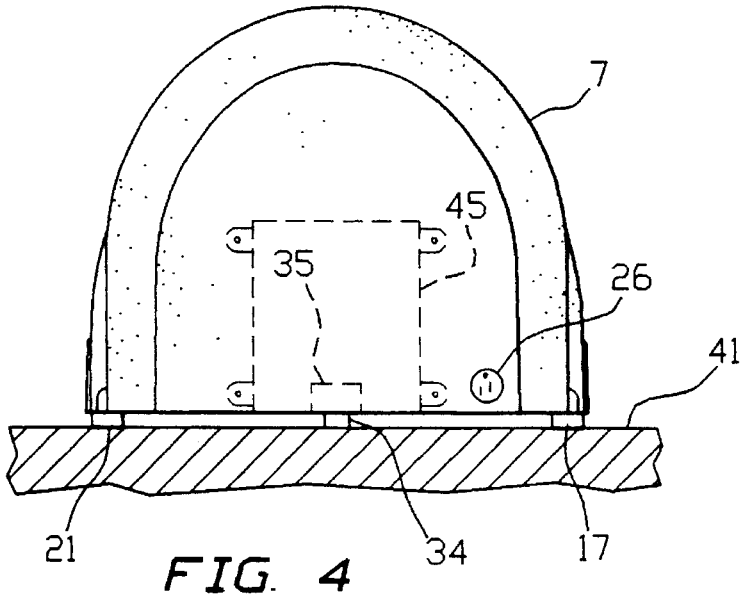
FIG. 4 is a back view of the preferred embodiment shown in FIG. 1.

The stepstool 1 is also comprised of an automatic electronic message mechanism whose housing 45 is attached to the inside of the back of the stepstool 1 and is shown as a hidden detail in FIGS. 1, 3 and 4. Protruding from the bottom of the message mechanism housing 45 is the plunger 34 portion of an on/off switch 35 (see FIGS. 3 and 4).

Figure 2B:
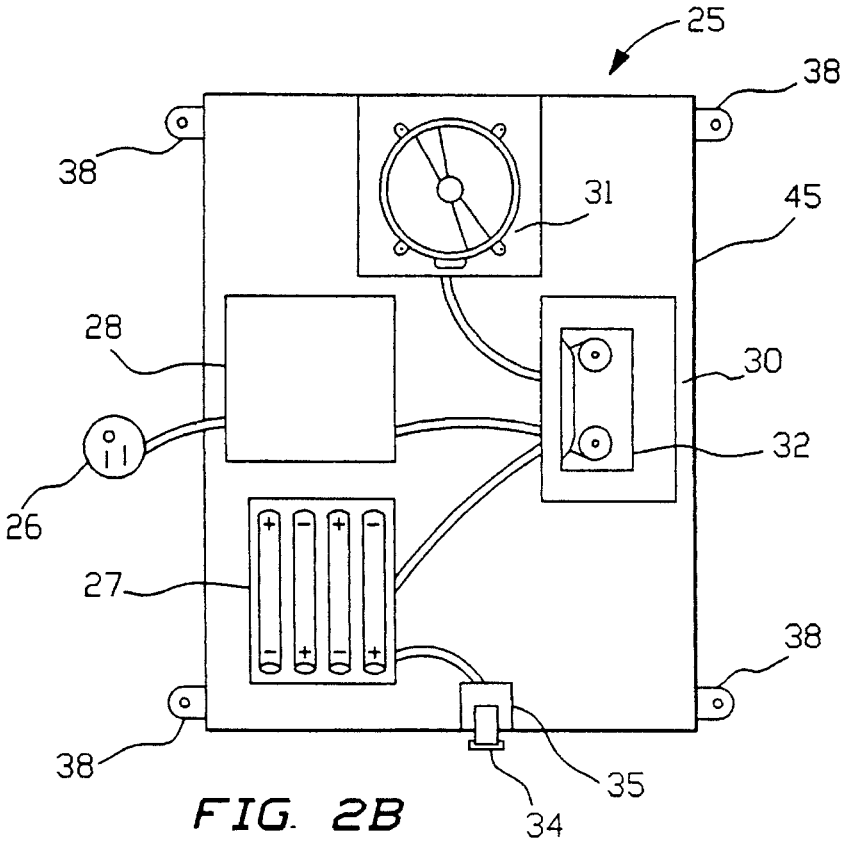
FIG. 2B is a detail of an alternative embodiment of an automatic electronic message mechanism.
Figure 2A:
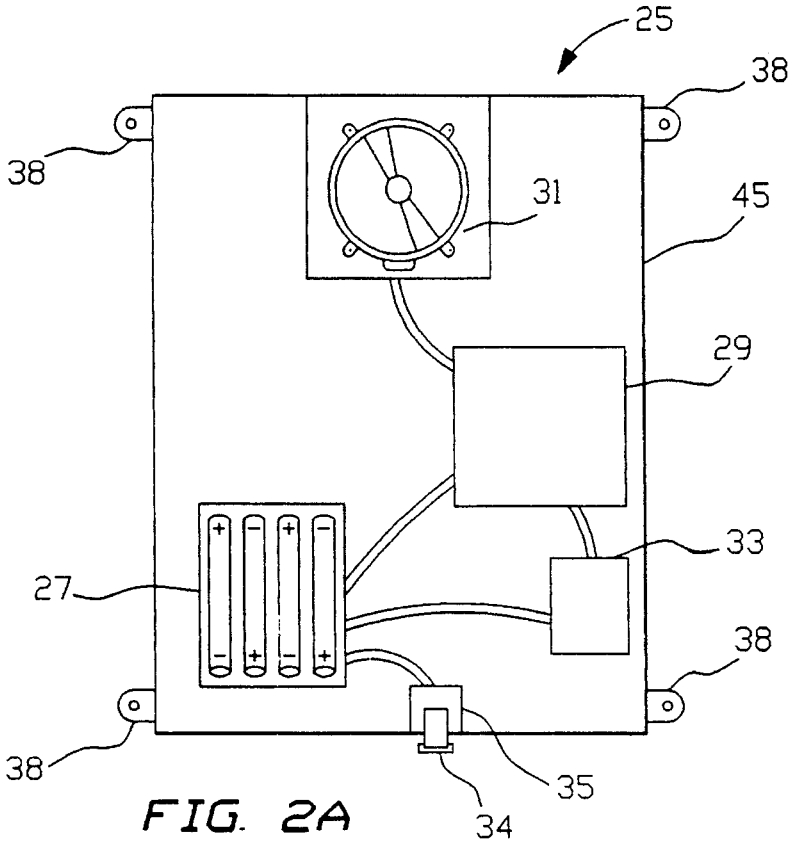
FIG. 2A is a detail of an automatic electronic message mechanism.

A preferred embodiment of an automatic electronic message mechanism 25 is detailed in FIG. 2A. The electronic message mechanism housing 45 has four fastener tabs which may be secured to the inside of the back of the stepstool 1 by threaded fasteners or snap into compression slots on the inside of the back of the stepstool 1. Shown is a power source 27, which is electrically connected to an on/off switch 35, and audio driver 29 and a predetermined message chip 33. The predetermined message chip 33 is also electrically connected to the audio driver 29. The audio driver 29 is electrically connected to a sound transducer or speaker 31. The power source 27 shown is a group of electrochemical batteries which may be lead based or rechargeable types such as nickel cadmium. The on/off switch 35 may be a contact type switch, cam switch or a plunger type switch as in the preferred embodiment. The "off" state of the switch corresponds to the plunger 34 being extended down just level with the floor 41 (see FIG. 4) when the stepstool 1 is not supporting any external weight on the horizontal step 5 portion of the main housing 3. This "off" state of the on/off switch corresponds to the uncompressed state of the compressive pods 17, 19, 21 and 23.

The predetermined message chip 33 is an integrated circuit which is digitally encoded with tones or frequencies necessary to replicate a predetermined message. When energized by the power source 27, the predetermined message chip 33 electrically transmits a composite of tones converted into analog form or frequencies to the audio driver 29. The audio driver 29 is an integrated circuit amplifier which amplifies the voltage of the composite frequencies sufficiently high enough in amplitude to the speaker for production of a predetermined message comprising words and/or music.

In a typical application of the step stool 1, the on/off switch 35 plunger 34 extends beyond the message housing 45 to its uncompressed position or "off" state just above the floor 41 (see FIG. 4). As a child steps onto the horizontal step 5 portion of the main housing 3 (see FIG. 1) the compressive pods 17, 19, 21, and 23 compress from their uncompressed height state to their second, compressed height state. At this compressed height state the plunger 34 of the on/off switch 35 compresses to its "on" state. At the "on" state, the on/off switch 35 permits the power source 27 to energize the predetermined message chip 33 and audio driver 28, thereby generating the predetermined words and/or music through the speaker. As the child steps off the horizontal step 5 portion of the main housing 3, the compressive pods depress from their compressed height state to their uncompressed height state and the plunger 34 of the on/off switch 35 depresses to its extended "off" position thereby disconnecting the power source 27 from the predetermined message chip 33 and audio driver 29.

In an alternative embodiment of the automatic electronic message mechanism 25, shown in FIG. 2B, the predetermined message may be on a removable microcassette audio tape 32 which is electrically transmitted to the speaker 31 by an audio tape driver 30. The audio tape driver 30 has an integral direct current motor drive for advancing the microcassette tape reel and a magnetic pickup head for retrieving the magnetic information on the microcassette tape and converting it to an amplified electrical signal for transmission to the speaker 31. The advantage of this embodiment is that the message can be customized by retrieving the microcassette tape 30 reel from the housing 45 and recording different messages on an external microcassette tape recorder. The microcassette tape 32 may then be inserted back into the microcassette tape drive 30 for automatic replay. In this way the messages may then be customized for particular holidays, a birthday, or specific hygiene tasks such as brushing teeth or washing. Also shown in the alternative embodiment in FIG. 2B is an optional alternating current transformer/rectifier 28. The transformer/rectifier 28 is an electronic industry standard apparatus that can allow the electronic message mechanism 25 to be powered by an alternating current household power source fed by way of a standard two pronged grounded receptacle plug 26 which can be fed out the back end of the stepstool as shown in FIG. 4. The transformer/rectifier 28 would step down the house hold voltage to an acceptable safe level and rectify it to a direct current wave form pattern suitable for the electronic components in the message mechanism 25. This optional alternating current transformer/rectifier could also be utilized in the preferred embodiment of the message mechanism shown in FIG. 2A with the transformer/rectifier being electrically connected to the on/off switch 35, predetermined message chip 33 and audio driver 29.

What is claimed is:

1. A stepstool for children with an automatic electronic message mechanism, which comprises:

a) a main housing which includes at least one horizontal step and a substantially vertical support connected to said step, said vertical support having a bottom;

b) at least one compressive pod located on the bottom of said substantially vertical support, said pod having a first, uncompressed height state, and having a second compressed height state, said second height being less than said first height, said second compressed height being establishable by application of a predetermined weight to said main housing;

c) an electronic message mechanism having a power source, an audio driver, a speaker, and a predetermined message chip having a predetermined message, and having an on/off switch, said audio driver and said predetermined message chip being electrically connected to said audio driver, said audio driver being electrically connected to said speaker, said electronic message mechanism being connected to said main housing and being positioned relative to said at least one compressive pod such that when said compressive pod is in its first, uncompressed height state, said switch is in its "off" position, and when said compressive pod is in its second, compressed height state, said switch is moved to its "on" position to activate said predetermined message.

2. The device in claim 1 wherein said power source is an array of electrochemical batteries.

3. The device in claim 1 further comprising portions of legs, said portions of legs being unistructurally formed with said main housing.

4. The device of claim 1 further comprising an animal shaped face, said animal shaped face being unistructurally formed with said main housing and said substantially vertical support.

5. The device of claim 2 further comprising portions of legs, said portions of legs being unistructurally formed with said main housing.

6. The device of claim 2 further comprising an animal shaped face, said animal shaped face being unistructurally formed with said main housing and said substantially vertical support.

7. The device of claim 3 further comprising an animal shaped face, said animal shaped face being unistructurally formed with said main housing and said substantially vertical support.

8. The device of claim 7 wherein said portions of legs have glow-in-the-dark effects and marking characteristics consistent with said animal shaped face.

9. The device of claim 1 wherein said on/off switch is a plunger type electrical contact switch.

10. The device of claim 1 further comprising a transformer/rectifier apparatus, said transformer/rectifier apparatus being electrically connected to said on/off switch, said audio driver and said predetermined message chip, said transformer/rectifier stepping down an alternating current voltage power source and rectifying said alternating current voltage power source to a direct current voltage power source.

11. A stepstool for children with an automatic electronic message mechanism, which comprises:

a) a main housing which includes at least one horizontal step and a substantially vertical support connected to said step, said vertical support having a bottom;

b) at least one compressive pod located on the bottom of said substantially vertical support, said pod having a first, uncompressed height state, and having a second compressed height state, said second height being less than said first height, said second compressed height being establishable by application of a predetermined weight to said main housing;

c) an electronic message mechanism having a power source, a microcassette tape having a predetermined message, a microcassette tape driver, a speaker, and having an on/off switch connected to said mechanism, said power source being electrically connected to said on/off switch and said microcassette tape driver, said microcassette tape being inserted into said microcassette tape driver, said microcassette tape driver being electrically connected to said speaker, said electronic message mechanism being connected to said main housing and being positioned relative to said at least one compressive pod such that when said compressive pod is in its first, uncompressed height state, said switch is in its "off" position, and when said compressive pod is in its second, compressed height state, said switch is moved to its "on" position to activate said predetermined message.

12. The device in claim 11 wherein said power source is an array of electrochemical batteries.

13. The device in claim 11 further comprising portions of legs, said portions of legs being unistructurally formed with said main housing.

14. The device of claim 11 further comprising an animal shaped face, said animal shaped face being unistructurally formed with said main housing and said substantially vertical support.

15. The device of claim 12 further comprising portions of legs, said portions of legs being unistructurally formed with said main housing.

16. The device of claim 12 further comprising an animal shaped face, said animal shaped face being unistructurally formed with said main housing and said substantially vertical support.

17. The device of claim 15 further comprising an animal shaped face, said animal shaped face being unistructurally formed with said main housing and said substantially vertical support.

18. The device of claim 17 wherein said portions of legs have glow-in-the-dark effects and characteristic markings consistent with said animal shaped face.

19. The device of claim 11 further comprising a transformer/rectifier apparatus, said transformer/rectifier apparatus being electrically connected to said microcassette tape driver, said transformer/rectifier stepping down an alternating current voltage and rectifying said alternating current voltage to a direct current voltage wave form.

20. The device of claim 11 wherein said on/off switch is a plunger type electrical contact switch.

* * * * *